US006843552B2

(12) United States Patent
McElfresh et al.

(10) Patent No.: US 6,843,552 B2
(45) Date of Patent: Jan. 18, 2005

(54) ELECTRICAL CIRCUIT FOR PRINTHEAD ASSEMBLY

(75) Inventors: David McElfresh, San Diego, CA (US); Noah Carl Lassar, San Diego, CA (US); Mohammad Akhavain, Escondido, CA (US); Brian J. Keefe, La Jolla, CA (US); Joseph E. Scheffelin, Poway, CA (US); Janis Horvath, San Diego, CA (US); Dale Dean Timm, Jr., Solana Beach, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 87 days.

(21) Appl. No.: 10/429,617

(22) Filed: May 5, 2003

(65) Prior Publication Data

US 2003/0202047 A1 Oct. 30, 2003

Related U.S. Application Data

(63) Continuation of application No. 09/783,411, filed on Feb. 14, 2001, now Pat. No. 6,557,976.

(51) Int. Cl.[7] ..... B41J 2/01
(52) U.S. Cl. ..... 347/50
(58) Field of Search ..... 347/12, 13, 20, 347/40, 42, 50, 58, 87

(56) References Cited

U.S. PATENT DOCUMENTS

| | | | | |
|---|---|---|---|---|
| 4,463,359 A | | 7/1984 | Ayata et al. | |
| 5,016,023 A | | 5/1991 | Chan et al. | |
| 5,079,189 A | | 1/1992 | Drake et al. | |
| 5,160,945 A | | 11/1992 | Drake | |
| 5,442,384 A | * | 8/1995 | Schantz et al. | 347/20 |
| 5,442,386 A | | 8/1995 | Childers et al. | |
| 5,469,199 A | | 11/1995 | Allen et al. | |
| 5,565,900 A | | 10/1996 | Cowger et al. | |
| 5,612,511 A | * | 3/1997 | Meyer et al. | 174/254 |
| 5,696,544 A | | 12/1997 | Komuro | |
| 5,719,605 A | | 2/1998 | Anderson et al. | |
| 5,734,394 A | | 3/1998 | Hackleman | |
| 5,742,305 A | | 4/1998 | Hackleman | |
| 5,755,024 A | | 5/1998 | Drake et al. | |
| 5,946,012 A | | 8/1999 | Courian et al. | |
| 6,053,598 A | | 4/2000 | Inpyn | |
| 6,071,427 A | | 6/2000 | Raulinaitis | |
| 6,241,340 B1 | | 6/2001 | Watanabe et al. | |
| 6,325,488 B1 | | 12/2001 | Beerling et al. | |
| 6,378,984 B1 | * | 4/2002 | Steinfield et al. | 347/47 |
| 6,394,580 B1 | * | 5/2002 | Scheffelin et al. | 347/50 |
| 6,727,115 B2 | * | 4/2004 | Van Hoff | 438/106 |

FOREIGN PATENT DOCUMENTS

EP 0822082 A2 2/1998

OTHER PUBLICATIONS

EPO Search Report dated Jun. 4, 2002 in related application 02250596.0–2304.

* cited by examiner

*Primary Examiner*—Anh T. N. Vo

(57) ABSTRACT

A printhead assembly includes a carrier having a first side and a second side contiguous with the first side, a plurality of printhead dies each mounted on the first side of the carrier, an electrical circuit including a first portion disposed on the first side of the carrier and a second portion disposed on the second side of the carrier, and a plurality of electrical connectors each electrically coupled to the first portion of the electrical circuit and one of the printhead dies. The electrical circuit has a plurality of openings defined in the first portion thereof such that each of the openings are sized to accommodate one of the printhead dies, and has a first side facing the carrier and a second side opposite the first side thereof such that each of the electrical connectors are electrically coupled to the second side of the electrical circuit and one of the printhead dies.

32 Claims, 4 Drawing Sheets

ELECTRICAL CIRCUIT FOR PRINTHEAD ASSEMBLY

CROSS REFERENCE TO RELATED APPLICATION

This is a continuation of application Ser. No. 09/783,411 filed on Feb. 14, 2001, now U.S. Pat. No. 6,557,976 which is hereby incorporated by reference herein.

THE FIELD OF THE INVENTION

The present invention relates generally to inkjet printheads, and more particularly to a wide-array inkjet printhead assembly.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, commonly referred to as a wide-array inkjet printing system, a plurality of individual printheads, also referred to as printhead dies, are mounted on a single carrier. As such, a number of nozzles and, therefore, an overall number of ink drops which can be ejected per second is increased. Since the overall number of drops which can be ejected per second is increased, printing speed can be increased with the wide-array inkjet printing system.

Mounting a plurality of printhead dies on a single carrier, however, requires a plurality of power, ground, and data lines for the printhead dies. As such, the single carrier must accommodate a plurality of electrical connections between the electronic controller and each of the printhead dies. Since each printhead die typically requires multiple electrical connections, any difficulty in completing such connections is compounded by the number of printhead dies.

Accordingly, a need exists for routing power, ground, and data lines between an electronic controller and a plurality of printhead dies mounted on a single carrier. More particularly, a need exist for facilitating the numerous electrical connections required by the plurality of printhead dies.

SUMMARY OF THE INVENTION

One aspect of the present invention provides a printhead assembly. The printhead assembly includes a carrier having a first side and a second side contiguous with the first side, a plurality of printhead dies each mounted on the first side of the carrier, an electrical circuit including a first portion disposed on the first side of the carrier and a second portion disposed on the second side of the carrier, and a plurality of electrical connectors each electrically coupled to the first portion of the electrical circuit and one of the printhead dies. The electrical circuit has a plurality of openings defined in the first portion thereof such that each of the openings are sized to accommodate one of the printhead dies, and has a first side facing the carrier and a second side opposite the first side thereof such that each of the electrical connectors are electrically coupled to the second side of the electrical circuit and one of the printhead dies.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
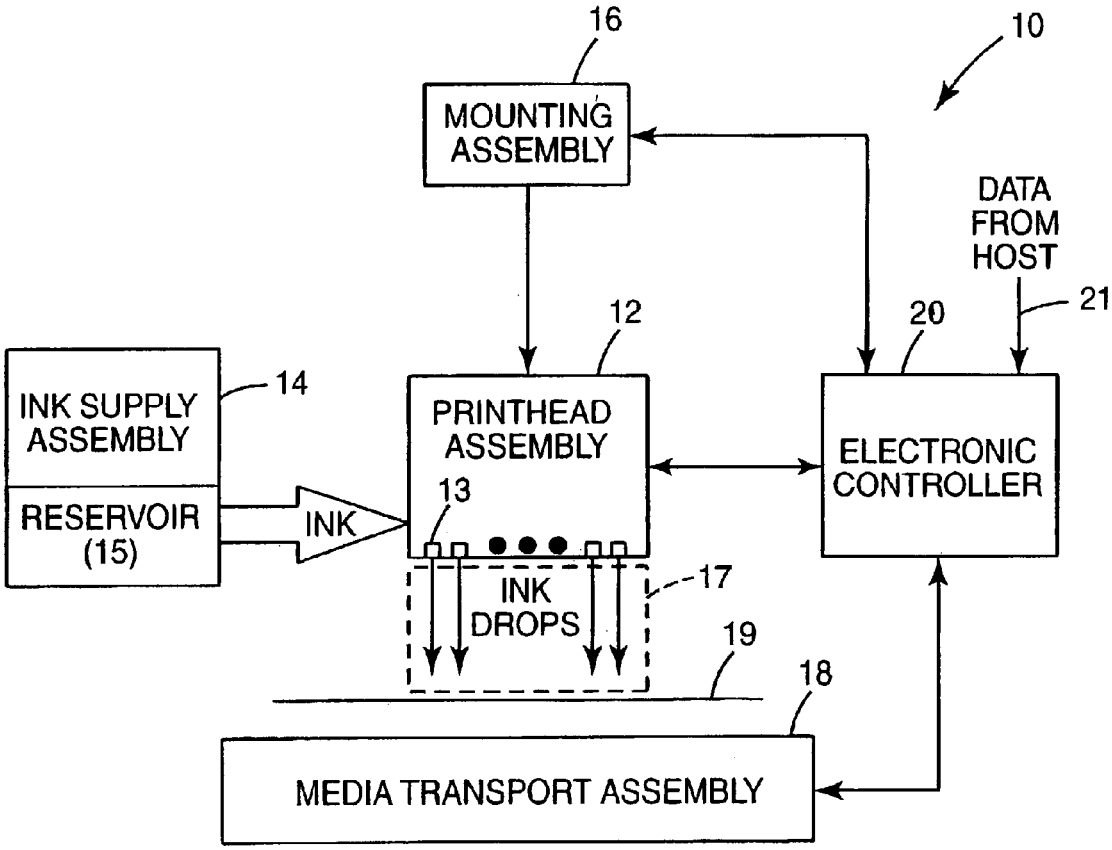
FIG. 1 is block diagram illustrating one embodiment of an inkjet printing system according to the present invention.

FIG. 1 illustrates one embodiment of an inkjet printing system 10 according to the present invention. Inkjet printing system 10 includes an inkjet printhead assembly 12, an ink supply assembly 14, a mounting assembly 16, a media transport assembly 18, and an electronic controller 20. Inkjet printhead assembly 12 is formed according to an embodiment of the present invention, and includes one or more printheads which eject drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
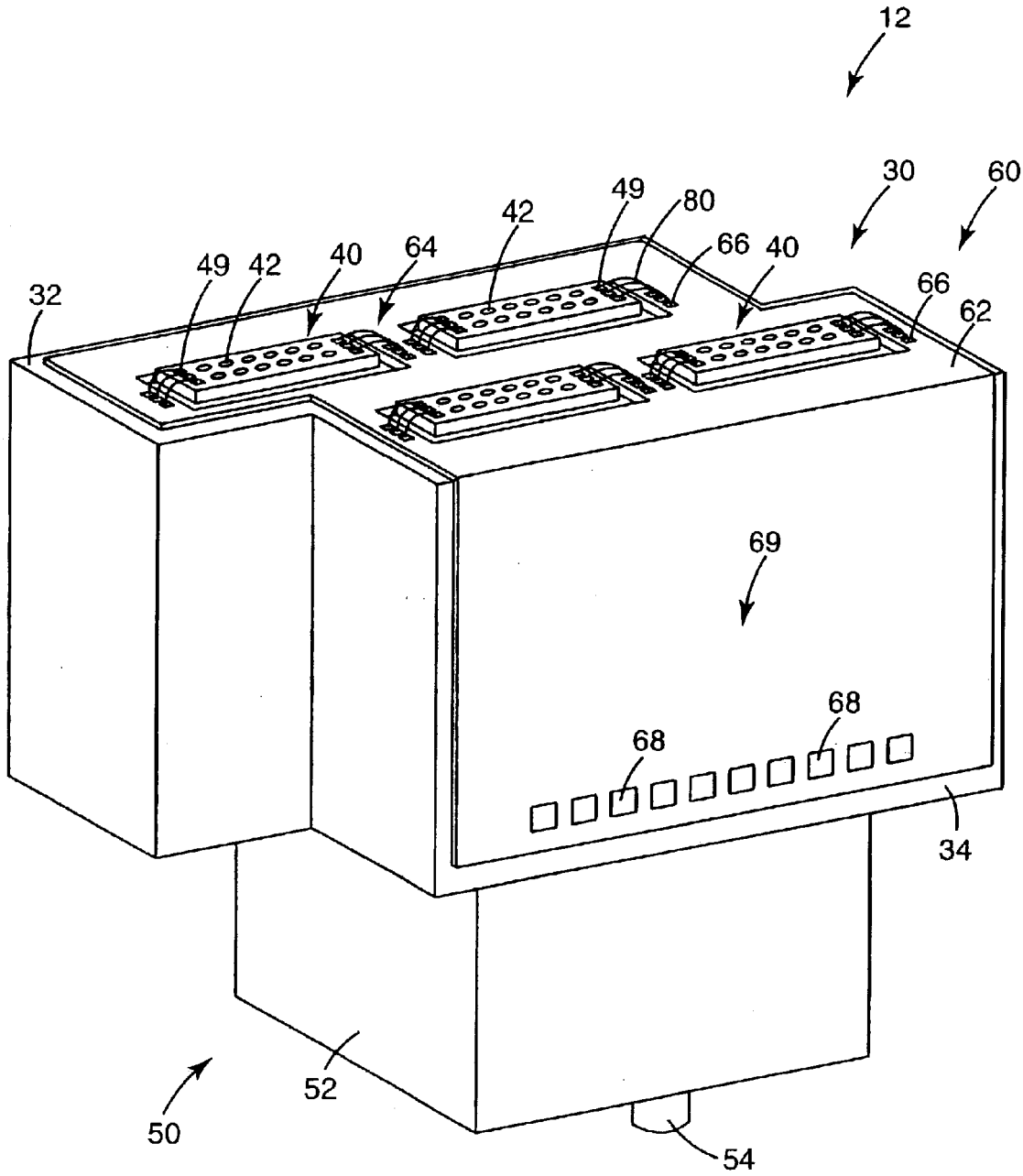
FIG. 2 is a top perspective view of an inkjet printhead assembly including a plurality of printhead dies and an electronic interface system according to the present invention.

FIG. 2 illustrates one embodiment of a portion of inkjet printhead assembly 12. Inkjet printhead assembly 12 is a wide-array or multi-head printhead assembly and includes a carrier 30, a plurality of printhead dies 40, an ink delivery system 50, and an electronic interface system 60. Carrier 30 has a first side 32 and a second side 34 which is contiguous with first side 32. Preferably, second side 34 is oriented substantially perpendicular to first side 32. Carrier 30 serves to carry printhead dies 40 and provide fluidic communication between printhead dies 40 and ink supply assembly 14 via ink delivery system 50. In one embodiment, carrier 30 is formed of plastic, ceramic, silicon, stainless steel, or other suitable material or combination of materials.

Printhead dies 40 are mounted on first side 32 of carrier 30 and aligned in one or more rows. In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. In one embodiment, a plurality of inkjet printhead assemblies 12 are mounted in an end-to-end manner. Carrier 30, therefore, has a staggered or stair-step profile. Thus, at least one printhead die 40 of one inkjet printhead assembly 12 overlaps at least one printhead die 40 of an adjacent inkjet printhead assembly 12. While four printhead dies 40 are illustrated as being mounted on carrier 30, the number of printhead dies 40 mounted on carrier 30 may vary.

Figure 3:
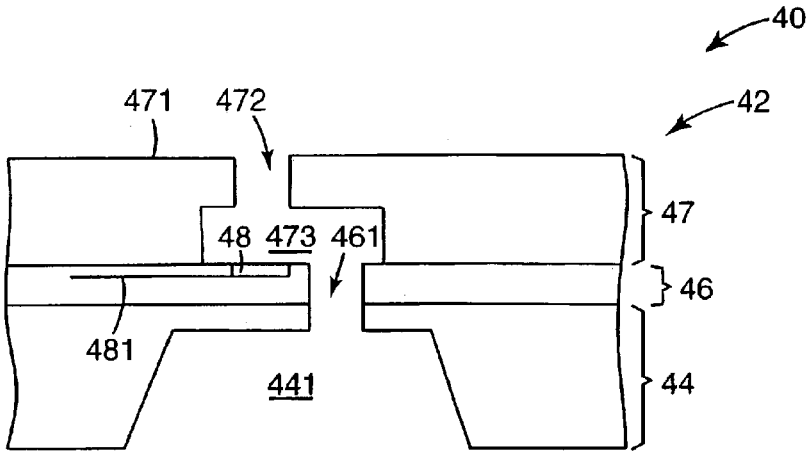
FIG. 3 is a schematic cross-sectional view illustrating portions of a printhead die according to the present invention.

As illustrated in FIGS. 2 and 3, each printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Ink delivery system 50 fluidically couples ink supply assembly 14 with printhead dies 40. In one embodiment, ink delivery system 50 includes a manifold 52 and a port 54. As such, manifold 52 is mounted on a side of carrier 30 opposite first side 32 and distributes ink through carrier 30 to each printhead die 40. Port 54 communicates with manifold 52 and provides an inlet for ink supplied by ink supply assembly 14.

Electronic interface system 60 electrically couples electronic controller 20 with printhead dies 40. As illustrated in FIG. 2, electronic interface system 60 includes an electrical circuit 62 and a plurality of electrical connectors 64. Electrical circuit 62 is disposed on first side 32 and second side 34 of carrier 30. As such, electrical circuit 62 facilitates electrical communication between second side 34 of carrier 30 and first side 32 of carrier 30 while electrical connectors 64 electrically couple printhead dies 40 on first side 32 of carrier 30 with electrical circuit 62.

Electrical circuit 62 includes a first plurality of electrical contacts 66 disposed on first side 32 of carrier 30 and a second plurality of electrical contacts 68 disposed on second side 34 of carrier 30. As such, electrical contacts 66 and 68 provide points for electrical connection to electrical circuit 62. More specifically, electrical contacts 66 form bond pads for electrical circuit 62 and electrical contacts 68 form input/output (I/O) contacts for electrical circuit 62.

Electrical contacts 68 of electrical circuit 62 provide an electrical interconnect 69 for inkjet printhead assembly 12. Electrical interconnect 69 facilitates electrical coupling between electronic controller 20 and inkjet printhead assembly 12 when inkjet printhead assembly 12 is installed in inkjet printing system 10. As such, electrical interconnect 69 includes, for example, I/O contact pads which mechanically or inductively contact corresponding electrical nodes electrically coupled to electronic controller 20. Thus, electrical circuit 62 provides electrical connection between printhead dies 40 on first side 32 of carrier 30 and electrical interconnect 69 on second side 34 of carrier 30.

Figure 4:
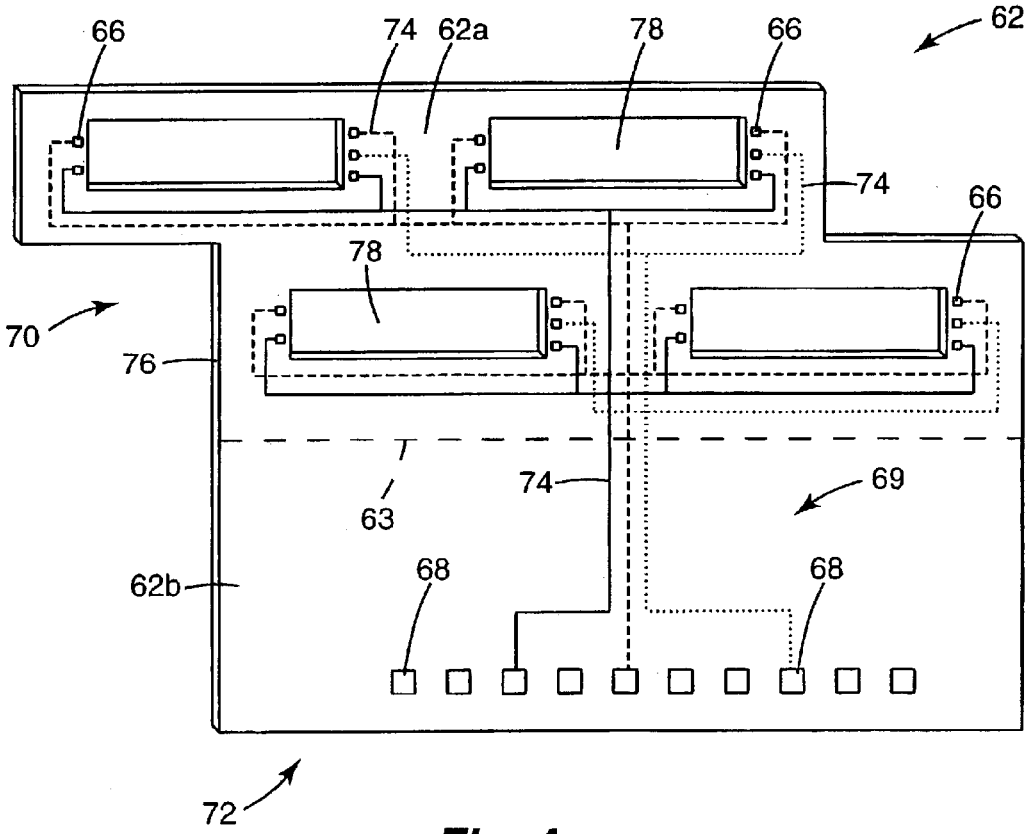
FIG. 4 is a schematic illustration of one embodiment of an electrical circuit of the electronic interface system of FIG. 2.

FIG. 4 illustrates one embodiment of electrical circuit 62. Electrical circuit 62 includes a first interface 70, a second interface 72, and a plurality of conductive paths 74 extending between first interface 70 and second interface 72. First interface 70 provides an input/output interface for communication with printhead dies 40 and second interface 72 provides an input/output interface for communication with electronic controller 20. Thus, first interface 70 facilitates electrical coupling between electrical circuit 62 and printhead dies 40 and second interface 72 facilitates electrical coupling between electrical circuit 62 and electronic controller 20.

First interface 70 includes electrical contacts 66 which form bond pads for electrical circuit 62 and second interface 72 includes electrical contacts 68 which form I/O contacts for electrical circuit 62. Conductive paths 74, therefore, extend between and provide electrical communication between electrical contacts 66 of first interface 70 and electrical contacts 68 of second interface 72.

Conductive paths 74 transfer electrical signals between electronic controller 20 and printhead dies 40. More specifically, conductive paths 74 define transfer paths for power, ground, and data among and/or between printhead dies 40 and electrical controller 20. In one embodiment, data includes print data and non-print data. Print data includes, for example, nozzle data containing pixel information such as bitmap print data. Non-print data includes, for example, command/status (CS) data, clock data, and/or synchronization data. Status data of CS data includes, for example, printhead temperature or position, print resolution, and/or error notification.

Preferably, electrical circuit 62 is a flexible electrical circuit. As such, conductive paths 74 are formed in one or more layers of flexible base material 76. Base material 76 may include, for example, a polyimide or other flexible polymer material (e.g., polyester, poly-methyl-methacrylate) and conductive paths 74 may be formed of copper, gold, or other conductive material.

In one embodiment, electrical circuit 62 includes a first portion 62*a* disposed on first side 32 of carrier 30 and a second portion 62*b* disposed on second side 34 of carrier 30. As such, first portion 62*a* includes first interface 70 and second portion 62*b* includes second interface 72 Dashed line 63 represents a bend line of electrical circuit 62 and, therefore, a boundary between first portion 62*a* and second portion 62*b* when electrical circuit 62 is overlaid on carrier 30.

In one embodiment, a plurality of openings 78 are defined in electrical circuit 62. More specifically, openings 78 are formed in base material 76. Openings 78 are formed in first portion 62*a* of electrical circuit 62 and are sized so as to accommodate printhead dies 40.

Figure 5:
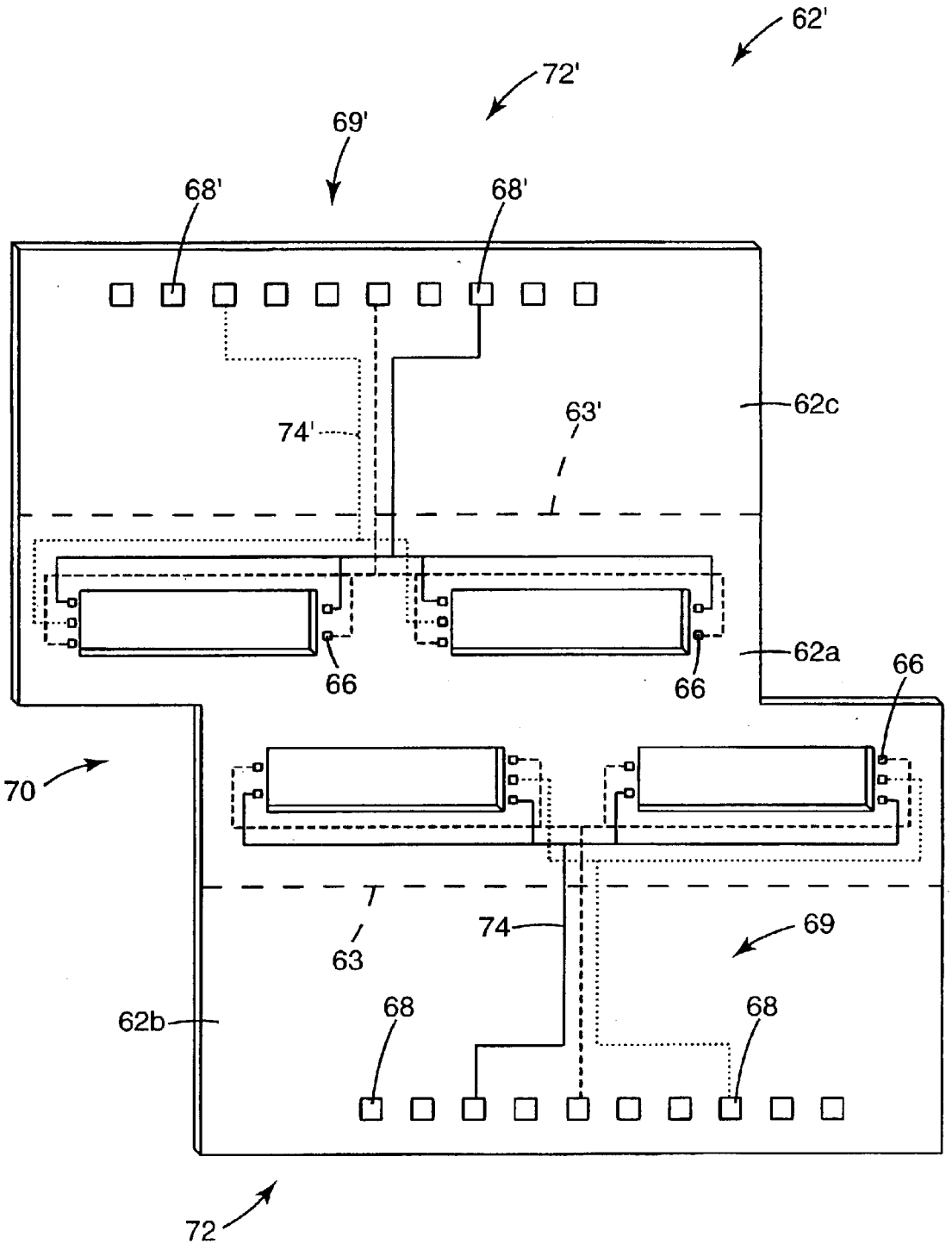
FIG. 5 is a schematic illustration of another embodiment of an electrical circuit of the electronic interface system of FIG. 2.

FIG. 5 illustrates another embodiment of electrical circuit 62. Electrical circuit 62' is similar to electrical circuit 62 and includes first interface 70 and second interface 72. Electrical circuit 62', however, also includes a third interface 72' similar to second interface 72. As such, electrical circuit 62' includes conductive paths 74' extending between first interface 70 and third interface 72'. Conductive paths 74' are similar to conductive paths 74 extending between first interface 70 and second interface 72. Second interface 72 and third interface 72', therefore, each provide an input/output interface for communication with electronic controller 20.

Third interface 72' includes electrical contacts 68' which form I/O contacts for electrical circuit 62'. Electrical contacts 68' of third interface 72' are similar to electrical contacts 68 of second interface 72 and provide an electrical interconnect 69' for inkjet printhead assembly 12. Conductive paths 74', therefore, extend between and provide electrical communication between electrical contacts 66 of first interface 70 and electrical contacts 68' of third interface 72'. Electrical interconnect 69' facilitates electrical coupling between electronic controller 20 and inkjet printhead assembly 12 in a manner similar to electrical interconnect 69.

In one embodiment, electrical circuit 62' includes first portion 62*a* disposed on first side 32 of carrier 30, second portion 62*b* disposed on second side 34 of carrier 30, and a third portion 62*c* disposed on a third side (not shown) of carrier 30. As such, third portion 62*c* includes third interface 72'. Dashed line 63' represents a bend line of electrical circuit 62' and, therefore, a boundary between first portion 62*a* and third portion 62*c* when electrical circuit 62' is overlaid on carrier 30. The third side of carrier 30 is opposite second side 34 and contiguous with first side 32. Preferably, the third side of carrier 30 is oriented substantially perpendicular to first side 32 and substantially parallel to second side 34.

As illustrated in FIG. 2, printhead dies 40 include electrical contacts 49 which form bond pads for printhead dies 40. As such, electrical connectors 64 electrically couple electrical contacts 66 of electrical circuit 62 with electrical contacts 49 of printhead dies 40. In one embodiment, electrical connectors 64 include wire bonds or wire leads 80. As such, one end of each wire lead 80 is electrically coupled to one electrical contact 66 of electrical circuit 62 and another end of each wire lead 80 is electrically coupled to one electrical contact 49 of one printhead die 40. Electrical coupling of wire leads 80 with electrical contacts 66 and electrical contacts 49 is accomplished, for example, by wire bonding. It is understood that the above description is also applicable to electrical coupling with electrical circuit 62'.

While electrical contacts 49 are illustrated as being provided on opposite ends of printhead dies 40, it is within the scope of the present invention for electrical contacts 49 to be provided at one end of printhead dies 40, along one side of printhead dies 40, and/or along both sides of printhead dies 40. As such, electrical contacts 66 of electrical circuit 0.62 are provided adjacent to electrical contacts 49 of printhead dies 40. In addition, it is also within the scope of the present invention for openings 78 to be sized so as to accommodate one or more printhead dies 40.

To assemble inkjet printhead assembly 12, electrical circuit 62 is overlaid on carrier 30 More specifically, first portion 62*a* of electrical circuit 62 is overlaid on first side 32 of carrier 30 and second portion 62*b* of electrical circuit 62 is overlaid on second side 34 of carrier 30. As such, openings 78 accommodate printhead dies 40. With electrical circuit 62', it is understood that third portion 62*c* is overlaid on the third side of carrier 30.

Preferably, printhead dies 40 are mounted on first side 32 of carrier 30 before electrical circuit 62 is overlaid on carrier 30. Printhead dies 40, however, may be mounted on first side 32 of carrier 30 after electrical circuit 62 is overlaid on carrier 30. With printhead dies 40 mounted on carrier 30 and electrical circuit 62 overlaid on carrier 30, wire leads 80 are electrically coupled to electrical contacts 66 of electrical circuit 62 and electrical contacts 49 of printhead dies 40. It is understood that wire leads 80 may be electrically coupled to electrical contacts 49 and then electrical contacts 66 or may be electrically coupled to electrical contacts 66 and then electrical contacts 49.

By utilizing electrical circuit 62 and electrical connectors 64, electrical communication between electronic controller 20 and inkjet printhead assembly 12 is facilitated. More specifically, by providing electrical circuit 62 with electrical contacts 66 and printhead dies 40 with electrical contacts 49, electrical connections between electrical circuit 62 and printhead dies 40 are facilitated. As such, electrical connectors 64 in the form of wire leads 80, for example, may be utilized to complete electrical connections between electrical circuit 62 and printhead dies 40.

By utilizing wire leads 80 to complete electrical connections between electrical circuit 62 and printhead dies 40, misalignment between printhead dies 40 and electrical circuit 62 may be accommodated. More specifically, since wire leads 80 have three degrees or axes of freedom (viz., x, y, z), misalignment of electrical contacts 66 of electrical circuit 62 and electrical contacts 49 of printhead dies 40 may be accommodated. In addition, by utilizing wire leads 80 to complete electrical connections between electrical circuit 62 and printhead dies 40, electrical connections established with wire leads 80 can be reworked. Thus, higher production yields and assembly throughput may be achieved with inkjet printhead assemblies which include electronic interface system 60.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A printhead assembly, comprising:

a carrier having a first side said a second side contiguous with the first aide;

a plurality of printhead dies each mounted on the first side of the carrier;

an electrical circuit including a first portion disposed on the first aide of the carrier and a second portion disposed on the second aide of the carrier, and having a plurality of opening defined in the first portion thereof, each of the openings sized to accommodate one of the printhead dies; and a plurality of electrical connectors each electrically coupled to the first portion of the electrical circuit and one of the printhead dies, wherein the electrical circuit has a first aids facing the carrier and a second aide opposite the first side thereof and wherein each of the electrical connectors are electrically coupled to the second aide of the electrical circuit and one of the printhead dies.

2. The printhead assembly of claim 1, wherein the electrical circuit includes a flexible electrical circuit having a plurality of conductive paths formed in a layer of flexible material.

3. The printhead assembly of claim 2, wherein the first portion of the electrical circuit includes a first plurality of electrical contacts and the second portion of the electrical circuit includes a second plurality of electrical contacts, and wherein at least one of the conductive paths of the flexible electrical circuit extends between at least one of the first plurality of electrical contacts and at least one of the second plurality of electrical contacts.

4. The printhead assembly of claim 2, wherein the conductive paths include at least one power path, at least one ground path, and at least one data path.

5. The printhead assembly of claim 1, wherein the carrier has a plurality of ink passages detined therein, at least one of the ink passages communicating with the first side of the carrier and at least one of the printhead dies.

6. The printhead assembly of claim 1, wherein the second side of the carrier is substantially perpendicular to the first side of the carrier.

7. The printhead assembly of claim 1, wherein first portion of the electrical circuit includes a first plurality of electrical contacts each formed adjacent to one of the openings defined in the first portion, and wherein each of the electrical connectors is electrically coupled to one of the first plurality of electrical contacts and one of the printhead dies.

8. The printhead assembly of claim 7, wherein the first plurality of electrical contacts are formed on the second side of the electrical circuit.

9. The printhead assembly of claim 7, wherein the second portion of the electrical circuit includes a second plurality of electrical contacts, the second plurality of electrical contacts defining at electrical interconnect for the printhead assembly.

10. The printhead assembly of claim 1, wherein each of the electrical connectors include a wire lead formed separately from the electrical circuit and having a first end electrically coupled to the second side of the electrical circuit and a second end electrically coupled to one of the printhead dies.

11. The printhead assembly of claim 1, wherein each of the printhead dies has a front face and a plurality of nozzle openings defined in the front face, and wherein each of the electrical connectors are electrically coupled to the front face of one of the printhead dies.

12. The printhead assembly of claim 1, wherein the plurality of printhead dies are mounted on the first side of the carrier before the electrical circuit is disposed on the first side and the second side of the carrier.

13. The printhead assembly of claim 1, wherein the plurality of printhead dies are mounted on the first side of the carrier after the electrical circuit is disposed on the first side and the second side of the carrier.

14. The printhead assembly of claim 1, wherein at least one of the electrical connectors is electrically coupled to the first portion of the electrical circuit before being electrically coupled to one of the printhead dies.

15. The printhead assembly of claim 1, wherein at least one of the electrical connectors is electrically coupled to the first portion of the electrical circuit after being electrically coupled to one of the printhead dies.

16. The printhead assembly of claim 1, wherein the electrical circuit further includes a third portion disposed on a third side of the carrier opposite the second side of the carrier, the third portion of the electrical circuit including a plurality of electrical contacts defining as electrical interconnect for the printhead assembly.

17. A method of forming a printhead assembly, the method comprising;

providing a carrier having a first side and a second side contiguous with the first side;

mounting a plurality of printhead dies on the first side of the carrier;

disposing a first portion of an electrical circuit on the first side of the carrier and a second portion of the electrical circuit on the second side of the carrier, the first portion having a plurality of openings defined therein, each of the opening accommodating one of the printhead dies; and electrically coupling a plurality of electrical connectors with the first portion of the electrical circuit and the printhead dies, wherein the electrical circuit has a first side facing the carrier and a second side opposite the first side thereof, and wherein electrically coupling the electrical connectors includes electrically coupling the electrical connectors with the second side of the electrical circuit and the printhead dies.

18. The method of claim 17, wherein the electrical circuit includes a flexible electrical circuit having a plurality of conductive paths formed in a layer of flexible material.

19. The method of claim 18, wherein the first portion of the electrical circuit includes a first plurality of electrical contacts and the second portion of the electrical circuit includes a second plurality of electrical contacts, and wherein at least one of the conductive paths of the flexible electrical circuit extends between at least one of the first plurality of electrical contacts and at least one of the second plurality of electrical contacts.

20. The method of claim 18, wherein the conductive paths include at least one power path, at least one ground path, and at least one data path.

21. The method of claim 17, wherein the carrier has a plurality of ink passages defined therein, wherein mounting the printhead dies on the first side of the carrier includes communicating at least one of the printhead dies with at least one of the ink passeges.

22. The method of claim 17, wherein the second side of the carrier is substantially perpendicular to the first side of the carrier.

23. The method of claim 17, wherein the first portion of the electrical circuit includes a plurality of electrical contacts each formed adjacent to one of the opening defined in the first portion, and wherein electrically coupling the electrical connectors includes electrically coupling the electrical connectors with the first plurality of electrical contacts and the printhead dies.

24. The method of claim 23, wherein the first plurality of electrical contacts are formed on the second side of the electrical circuit.

25. The method of claim 23, wherein the second portion of the electrical circuit includes a second plurality of electrical contacts, and further comprising:

defining an electrical interconnect for the printhead assembly plurality of electrical contacts.

26. The method of claim 17, wherein each of the electrical connectors includes a wire lead formed separately from the electrical circuit, and wherein electrically coupling the electrical connectors includes electrically coupling a first end of the wire lead with the second side of the electrical circuit and electrically coupling a second end of the wire lead with one of the printhead dies.

27. The method of claim 17, wherein each of the printhead dies has a front face and a plurality of nozzle opening defined in the front face, and wherein electrically coupling the electrical connectors includes electrically coupling each of the electrical connectors with the front face of one of the printhead dies.

28. The method of claim 17, wherein mounting the printhead dies on the first side of the carrier and disposing the electrical circuit on the first side and the second side of the carrier include mounting the printhead dies on the first side of the carrier before disposing the electrical circuit on the first side and the second side of the carrier.

29. The method of claim 17, wherein mounting the printhead dies on the first side of the carrier and disposing the electrical circuit on the first side and the second side of the carrier include mounting the printhead dies on the first side of the carrier after disposing the electrical circuit on the first side and the second side of the carrier.

30. The method of claim 17, wherein electrically coupling the electrical connectors includes electrically coupling at least one of the electrical connectors with the first portion of the electrical circuit before electrically coupling the at least one of the electrical connectors with one of the printhead dies.

31. The method of claim 17, wherein electrically coupling the electrical connectors includes electrically coupling at the electrical connectors with the first portion of the electrical circuit after electrically coupling the at least one of the electrical connectors with one of the printhead dies.

32. The method of claim 17, further comprising:

disposing a third portion of the electrical circuit on a third of the side of the carrier opposite the second side of the carrier, the third portion of the electrical circuit including a plurality of electrical contacts, and defining an electrical interconnect for the printhead assembly with the electrical contacts.

* * * * *